US005773932A

United States Patent [19]

Ooyama et al.

[11] Patent Number: 5,773,932

[45] Date of Patent: Jun. 30, 1998

[54] METAL HALIDE LAMP WITH REDUCED COLOR SHADOWING

[75] Inventors: Masachika Ooyama; Mitsuo Narita; Yoshio Okazaki, all of Himeji, Japan

[73] Assignee: Ushiodenki Kabushiki Kaisha, Toyko, Japan

[21] Appl. No.: 703,602

[22] Filed: Aug. 23, 1996

[30] Foreign Application Priority Data

Sep. 6, 1995 [JP] Japan ..... 7-252026

[51] Int. Cl.[6] ..... H01J 61/20

[52] U.S. Cl. ..... 313/639; 313/637; 313/638; 313/640

[58] Field of Search ..... 313/639, 637, 313/638, 640, 641, 490

[56] References Cited

U.S. PATENT DOCUMENTS 3,842,307 10/1974 Dobrusskin et al. ..... 313/640

5,028,843 7/1991 Narita ..... 313/639

5,451,838 9/1995 Kawai ..... 313/640

*Primary Examiner*—Sandra L. O'Shea

*Assistant Examiner*—Vip Patel

*Attorney, Agent, or Firm*—Sixbey, Friedman, Leedom & Ferguson; David S. Safran

[57] ABSTRACT

A metal halide lamp in which no color shadowing occurs on the light acceptance surface and which at the same time emits with sufficient brightness is achieved according to the invention by encapsulating lutetium halide and one or more of the metal halides from groups A, B and C in an arc tube of a metal halide lamp together with a mercury halide:

Group A: dysprosium halide, holmium halide, erbium halide, thulium halide

Group B: cerium halide, praseodymium halide, neodymium halide

Group C: cesium halide.

4 Claims, 1 Drawing Sheet

METAL HALIDE LAMP WITH REDUCED COLOR SHADOWING

BACKGROUND OF THE INVENTION

1. Field of the Invention

The invention relates to a metal halide lamp, especially to a metal halide lamp which is used for a liquid crystal projector.

2. Description of the Related Art

In a metal halide lamp, mercury, rare gas and metal halide are encapsulated in an arc tube for purposes of emission with color reproduction. Scandium, sodium, dysprosium, neodymium, tin, thulium, cerium or the like is used as a compound of iodine or bromine for this metal halide. These metal halides are present as a liquid in the vicinity of the wall of the arc tube during luminous operation of the lamp. Some of the liquid, however, also vaporizes. This vaporized metal halide dissociates into metal atoms and halogen atoms in the center region of the arc. The metal atoms emit a spectrum which is characteristic of the metal. Furthermore, the metal halide molecules in the periphery of the arc are excited and emit a spectrum which is characteristic of the metal halide. This means that the spectrum emitted in the center region of the arc differs from the spectrum emitted on the periphery of the arc.

In the case of using a metal halide lamp for a liquid crystal projector or the like, the lamp is generally combined with a focussing mirror so as to be located such that its arc axis agrees with the mirror axis in order to increase the focussing efficiency of the focussing mirror. Mainly, the emission of the arc center region is projected on the center region of a light acceptance surface, such as a screen or the like, while the light of the arc periphery is projected mainly onto the peripheral area of the light acceptance surface. This means that a so-called color shadowing phenomenon occurs on the light acceptance surface since the emission spectrum in the center region of the arc differs from the emission spectrum of the arc periphery, as was described above.

On the one hand, there is a growing call to reduce the size of liquid crystal projectors. Consequently, there is more and more frequently a demand for reducing the size, not only of the metal halide lamp used, but also of the focussing mirror which surrounds it and the current source. On the other hand, it is of course necessary to accomplish projection on the screen with high illumination intensity. This means that a light source is required in which the size of the lamp and other devices is reduced, and which at the same time has sufficient brightness.

SUMMARY OF THE INVENTION

Therefore, a primary object of the present invention is to devise a metal halide lamp in which no color shadowing occurs on the light acceptance surface and which, at the same time, emits light with sufficient brightness.

This object is achieved according to a preferred embodiment of the invention by encapsulating lutetium halide and one or more of the metal halides described below in groups A, B and C, in an arc tube of a metal halide lamp, together with a mercury halide:

| | |
|---|---|
| Group A: | dysprosium halide, holmium halide, erbium halide, thulium halide |
| Group B: | cerium halide, praseodymium halide, neodymium halide |
| Group C: | cesium halide |

Additionally, the object of the invention is advantageously achieved by one or more of the metal halides from each of the above described groups A, B and C being selected and encapsulated.

The object of the invention is, moreover, advantageously achieved by the fact that the molar ratio of the total amount of the halogen elements for the metal halides described above in groups A, B and C relative to the total amount of all halogen elements within the arc tube is in the range from 0.4 to 0.8.

The inventors have found that to eliminate color shadowing, encapsulation in the arc tube of lutetium and rare earth metals besides lutetium is effective. The conceivable reason for this is that lutetium emission is essentially the same both in the center region of the arc as well as on its periphery.

On the other hand, to accomplish emission with color reproduction, for a red emission dysprosium, holmium and the like, and for a green emission cerium, praseodymium and neodymium are encapsulated. Furthermore, to prevent devitrification of the arc tube cesium is encapsulated. In addition, to increase the brightness, besides the halogen which joins the above described rare earth metals, another halogen is also encapsulated.

In addition, by establishing the encapsulation amount of the halogen substance with consideration of the above described relationships, a more advantageous metal halide lamp can be devised.

In the following, the invention is further described using the single embodiment shown in the drawing.

DETAILED DESCRIPTION OF THE PREFERRED EMBODIMENT

Figure 1:
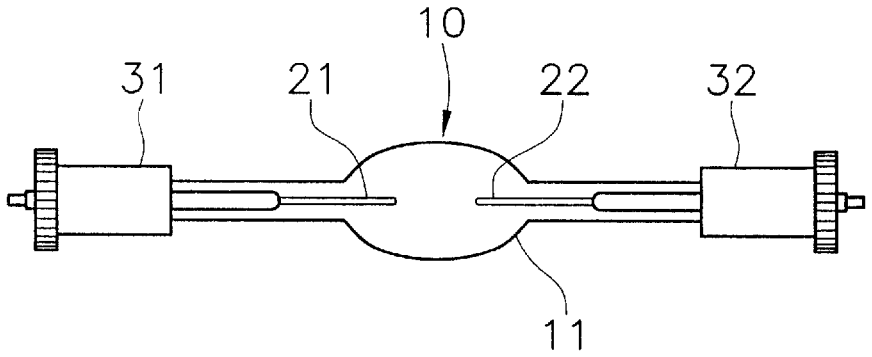
FIG. 1 shows a schematic illustration of a metal halide lamp according to the invention.

In FIG. 1, a metal halide lamp according to the invention is shown which is comprised of an arc tube 10 made of quartz glass, within which mercury and rare gas are encapsulated, and within which, at the same time, lutetium, other rare earth metals and mercury halide are encapsulated, as described below. In the center of arc tube 10, there is an emission part 11 within which there is a pair of opposed electrodes 21, 22. During luminous operation of the lamp, an arc discharge forms between this pair of electrodes 21 and 22. Bases 31 and 32 are connected to the outer ends of the electrodes 21 and 22, respectively.

The mercury and the rare gas are necessary to maintain the arc discharge. Their amounts are suitably selected. For example xenon or argon is used as the rare gas. This lamp is operated, for example, with 80 V and 150 W. Arc tube 10 has an internal volume of 0.4 $cm^3$ and an arc length of 5.0 mm. A total amount of 100 torr of argon and 10 mg of mercury are encapsulated in the arc tube 10.

Among the encapsulated substances, lutetium is used mainly to eliminate color shadowing and is encapsulated in the form of a halide, that is, as lutetium iodide ($LuI_3$) and lutetium bromide ($LuBr_3$). Furthermore, if necessary, one or more substances, selected from dysprosium (Dy), holmium (Ho), erbium (Er) and thulium (Tm) is/are encapsulated in halide form, that is, in iodide or bromide form, in order to relatively intensify continuous emission with red color.

Further, if necessary, one or more of the compounds of cerium (Ce), praseodymium (Pr) and neodymium (Nd) is/are also encapsulated in halide form, that is, in iodide or bromide form, in order to relatively intensify continuous emission with green color. Moreover, to prevent devitrification of arc tube 10, cesium (Cs) is likewise encapsulated in the form of a halide, that is, in iodide or bromide form.

This means that, to eliminate color shadowing, it is effective to encapsulate not only lutetium, but also rare earth metals besides lutetium. Besides lutetium, therefore, dysprosium, holmium, cerium and the like, which develop color reproduction, are encapsulated as these rare earth metals. These rare earth metals are generally not encapsulated as elements, but in the form of halides. This is because the vapor pressure in metal elements can be reduced by halide generation, because easier emission is achieved in this way, and because, furthermore, simple handling is achieved also with respect to lamp production.

In the following, tests are described with respect to the color shadowing and the illumination intensity of the metal halide lamp according to the invention.

In the tests, metal halide lamps were used in which lutetium iodide, dysprosium iodide, neodymium iodide, cesium iodide and mercury iodide were encapsulated. For dysprosium iodide, neodymium iodide, lutetium iodide and cesium iodide, the ratio of the total amount of all the halogen elements, including mercury iodide, to the total amount of the halogen which is bound to the metal was changed so as to be different from one lamp to another. This means that, with respect to the value of C, color shadowing and illumination intensity were measured, the ratio having been designated C, at which the total amount of the halogen which is bound to dysprosium iodide, neodymium iodide, lutetium iodide and cesium iodide is divided by the total amount of all halogens, including the mercury iodide.

In the tests, all of the above described lamps were operated with 150 W. The illumination intensity in the center of the screen was measured with an illumination meter and designated the central illumination intensity (Ix). Furthermore, colors in the peripheral area and in the center area of the screen were measured using a spectrometer and their difference indicated as the difference DUV. In this case, the term DUV is defined as the deviation from the color of black-body radiation based on Planck's Law. The screen used in the test measured 813 mm wide×610 mm high. The measurement was taken in a state in which the distance from the lamp was 1.5 m. This means that the test was run in a state which is essentially identical to conventional use of a liquid crystal projector.

The result is described in the following in which lamp 1 designates a lamp in which no lutetium is encapsulated, and lamp 2 designates a lamp in which lutetium iodide, dysprosium iodide, neodymium iodide, and cesium iodide are encapsulated, but no mercury iodide is encapsulated. Lamps 3, 4 and 5 designate lamps in which mercury iodide is encapsulated.

| | C | Central illumin. intensity | Central DUV | Peripheral DUV | DUV difference |
|---|---|---|---|---|---|
| Lamp 1 | — | 13200 | 0.0247 | 0.0129 | 0.0118 |
| Lamp 2 | 1.00 | 12000 | 0.0120 | 0.0109 | 0.0011 |
| Lamp 3 | 0.77 | 13100 | 0.0130 | 0.0122 | 0.0008 |
| Lamp 4 | 0.40 | 14400 | 0.0270 | 0.0154 | 0.0116 |
| Lamp 5 | 0.30 | 14200 | 0.0302 | 0.0160 | 0.0142 |

From the above results, it was determined that it is necessary that the value of "C" be less than or equal to 0.77 in order to maintain a numerical value greater than or equal to the numerical value (13000 lux) at which the central illumination intensity can be rated as "sufficiently bright". On the other hand, to prevent the occurrence of color shadowing it is necessary that the value of C be greater than or equal to 0.40 and less than or equal to 1.00. In these cases, the DUV differences in the above table are small.

This indicates that it is advantageous that the value of "C" be greater than or equal to 0.40 and less than or equal to 0.77 in order to adequately maintain the "illumination intensity" and at the same time eliminate color shadowing.

As is described above, it is apparent that it is advantageous that the lutetium halide, the halides of the other rare earth metals and the mercury halide be fixed such that the above described condition of "C" be satisfied. Specifically, the metals can be encapsulated with the composition described below:

$$0.6 \leqq Dy/Nd \leqq 3.2$$

$$0.4 \leqq Lu/Nd \leqq 2.4$$

$$0.4 \leqq (Dy+Nd+Lu)/Cs \leqq 2.5$$

Below a light source device for a liquid crystal projector is described in which the metal halide lamp according to the invention is used.

Figure 2:
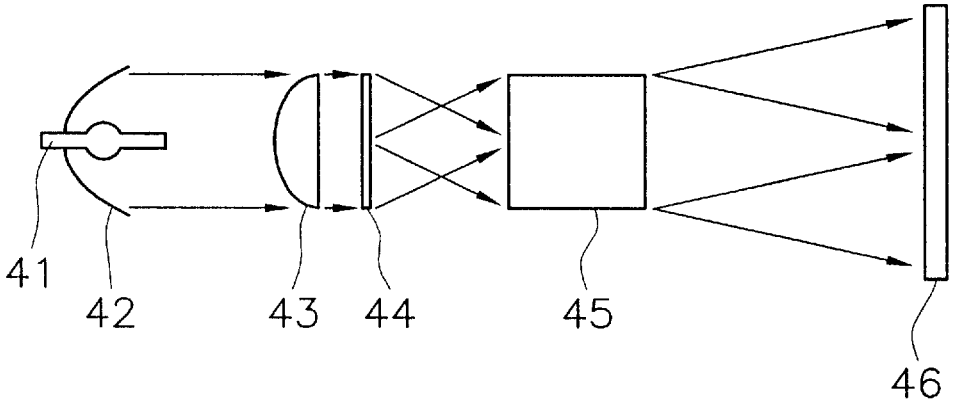
FIG. 2 schematically depicts a light source device in which the metal halide lamp according to the invention is used.

In FIG. 2, a lamp 41 is arranged within a focussing mirror 42 such that the arc axis agrees with the mirror axis. The radiant light from lamp 41 is projected directly or by reflection by means of the focussing mirror 42 after passage through a condenser lens 43, a liquid crystal surface 44 and a projector lens 45 onto a light acceptance surface 46.

Here, among the rare earth metals which are described above in groups A, B and C, each rare earth metal can be encapsulated together with the lutetium. Furthermore, in the case of encapsulation of several rare earth metals, several rare earth metals can be encapsulated either from the same group, for example, dysprosium halide and holmium halide, or from different groups, for example, dysprosium halide and cerium halide.

It is to be understood that although a preferred embodiment of the invention has been described, various other embodiments and variations may occur to those skilled in the art. Any such other embodiments and variations which fall within the scope and spirit of the present invention are intended to be covered by the following claims.

What we claim is:

1. A metal halide lamp, comprising:

lutetium halide and at least one metal halide selected from each groups A, B and C are encapsulated in an arc tube together with a mercury halide, where Group A consists of dysprosium halide, holmium halide, erbium halide, and thulium halide;

Group B consists of cerium halide, praseodymium halide, and neodymium halide; and Group C consists of cesium halide.

2. A metal halide lamp according to claim 1, wherein a molar ratio of the total amount of the halogen elements of the encapsulated metal halides from groups A, B and C to the total amount of all halogen elements within the arc tube is in a range of from 0.4 to 0.8.

3. A metal halide lamp, comprising:

lutetium halide and at least one metal halide selected from at least one of groups A, B and C are encapsulated in an arc tube together with a mercury halide, where Group A consists of dysprosium halide, holmium halide, erbium halide, and thulium halide;

Group B consists of cerium halide, praseodymium halide, and neodymium halide; and Group C consists of cesium halide;

wherein a molar ratio of the total amount of halogen elements of the encapsulated metal halides from groups A, B and C to the total amount of all halogen elements within the arc tube is in a range of from 0.4 to 0.8.

4. A method of producing light with a metal halide lamp without color shadowing, comprising the steps of forming a metal halide lamp by encapsulating lutetium halide and at least one metal halide selected from each of groups A, B and C in an arc tube together with a mercury halide, where Group A consists of dysprosium halide, holmium halide, erbium halide, and thulium halide;

Group B consists of cerium halide, praseodymium halide, and neodymium halide; and Group C consists of cesium halide;

and operating said lamp with a source of electrical power so as to cause light to be emitted from the arc tube without color shadowing.

* * * * *